US005423924A

United States Patent [19]

Reiniche et al.

[11] Patent Number: 5,423,924

[45] Date of Patent: Jun. 13, 1995

[54] METHOD FOR THE HEAT TREATMENT OF AT LEAST ONE METAL WIRE WITH HEAT-TRANSFER PLATES

[75] Inventors: Andre Reiniche, Clermont-Ferrand; Christian Chanet, Cournon-D'Auvergne, both of France

[73] Assignee: Compagnie Generale Desetablissements Michelin - Michelin & CIE, Clermont-Ferrand Cedex, France

[21] Appl. No.: 555,942

[22] Filed: Jul. 20, 1990

[30] Foreign Application Priority Data

Jul. 26, 1989 [FR] France ..... 89 10324

[51] Int. Cl.[6] ..... C21D 9/573

[52] U.S. Cl. ..... 148/600; 148/656; 148/658; 266/44

[58] Field of Search ..... 148/16, 128, 156; 266/44, 103

[56] References Cited

U.S. PATENT DOCUMENTS

| | | | |
|---|---|---|---|
| 3,752,458 | 8/1973 | Tokuda et al. | 266/110 |
| 4,581,512 | 4/1986 | McGinn et al. | 219/10.491 |
| 4,983,227 | 1/1991 | Reiniche et al. | 148/128 |

FOREIGN PATENT DOCUMENTS

| | | |
|---|---|---|
| 2359209 | 2/1978 | France . |
| 914862 | 6/1954 | Germany . |
| 2055964 | 6/1971 | Germany . |
| 2111631 | 3/1972 | Germany . |

*Primary Examiner*—Richard O. Dean
*Assistant Examiner*—Margery S. Phipps
*Attorney, Agent, or Firm*—Brumbaugh, Graves, Donohue & Raymond

[57] ABSTRACT

A method for the heat treatment of at least one metal wire (1), characterized by passing the wire (1) within at least one pair of thermal transfer plates (2, 2*a*, 2*b*) between two grooves (8, 8*a*, 8*b*) made in the two plates (2, 2*a*, 2*b*) of each of said pairs, adjusting the variable distance (E) between the plates, so that the wire (1) is directly in contact with a gas (11) which is practically without forced ventilation and is disposed between the grooves (8, 8*a*, 8*b*).

6 Claims, 6 Drawing Sheets

METHOD FOR THE HEAT TREATMENT OF AT LEAST ONE METAL WIRE WITH HEAT-TRANSFER PLATES

BACKGROUND OF THE INVENTION

The present invention relates to methods and devices which make it possible to heat-treat metal wires, particularly carbon-steel wires, for instance for the purpose of obtaining a fine pearlitic structure. These wires are used, in particular, to reinforce rubber and/or plastic articles, for instance automobile tires.

French Patent Application 88/00904 describes a method and a device for effecting a pearlitization treatment in which the wire is passed within one or more tubes containing a gas which is practically without forced ventilation. That method and device have the following advantages:

simplicity, low investment and operating expenses;

a precise law of cooling can be obtained and recalescence avoided;

a pearlitization treatment can be carried out with the same installation on wires whose diameter varies within wide limits;

all problems of hygiene are avoided and cleaning of the wire is not necessary since the use of molten metals or salts is avoided.

Experience shows, however, that for steels of a slightly different chemical composition (in particular carbon content slightly below or above the eutectoid), the TTT (time, temperature, texture) curves may be very different. This phenomenon is even observed in the case of steels which have identical chemical compositions but come from different steel mills.

Thus, by way of example, in the case of steels with 0.8% carbon it is current practice to have incubation times which vary within ratios of 1 to 1.7, the incubation time being the time elapsing between the start of the cooling and the start of the austenite/pearlite transformation, this making it necessary to use installations having different construction parameters in order to treat steel wires of the same diameter and identical or similar compositions in order to obtain an optimal steel structure in all cases.

SUMMARY OF THE INVENTION

The object of the invention is to propose a method and a device for thermally treating a metal wire which is of good adaptability; adaptability can be defined, in particular, as the ability to obtain identical time-temperature curves for wires of the same diameter having different TTT curves.

In the aforementioned Patent Application 88/00904, the flow of heat exchanged by the wire is substantially controlled by the thermal conductivity and the dimensions of the ring of gas surrounding the wire to be treated. The present invention makes it possible to obtain the adaptability by modifying and/or regulating the dimensions of said gaseous ring.

Accordingly, the method of the invention for the thermal treatment of at least one metal wire is characterized by the following features:

(a) the wire is passed within at least one pair of thermal transfer plates between two grooves provided on the two plates of each of these pairs, the distance between the plates being variable, and the wire being directly in contact with a gas which is practically without forced ventilation, disposed between the grooves;

(b) the characteristics of the grooves, the wire and the gas define the ratio K by the equation:

$$K = \frac{\text{Log}\,(Di/Df)}{\lambda} \times Df^2 \quad (1)$$

in which $$Di = \sqrt{4S/\pi} \quad (2)$$

Log being the natural logarithm and S being the area of the combination of the two grooves facing each other, this area, expressed in $mm^2$, corresponding to the section of the grooves by a plane perpendicular to the longitudinal direction of the wire, $D_f$ being the diameter of the wire expressed in millimeters and $\lambda$ being the thermal conductivity of the gas determined at 600° C., expressed in watt.$m^{-1}$.°$K^{-1}$.

The invention also concerns a device for the heat treatment of at least one metal wire, the device being characterized by the following features:

(a) it comprises a pair of thermal transfer plates as well as means making it possible to vary the distance between the plates and means making it possible to pass the wire within the pair; each plate has a groove so as to form two grooves facing each other between which the wire passes; the wire is directly in contact with a gas which is practically without forced ventilation and is disposed between the grooves;

(b) the characteristics of the grooves, the wire and the gas define the ratio K by the equation:

$$K = \frac{\text{Log}\,(Di/Df)}{\lambda} \times Df^2 \quad (1)$$

in which $$Di = \sqrt{4S/\pi} \quad (2)$$

Log being the natural logarithm, S being the area of the combination of the two grooves facing each other, said area, expressed in $mm^2$ corresponding to the section of the grooves by a plane perpendicular to the longitudinal direction of the wire, $D_f$ being the diameter of the wire expressed in millimeters and $\lambda$ being the thermal conductivity of the gas determined at 600° C., expressed in watt.$m^{-1}$.°$K^{-1}$.

The expression "practically without forced ventilation" means that the gas between the grooves is either stationary or subjected to slight ventilation which practically does not modify the heat exchanges between the wire and the gas, this slight ventilation being, for instance, due solely to the displacement of the wire itself.

The invention also concerns the methods and complete installations for the treatment of wires employing the method and the device previously described.

The invention also concerns the metal wires obtained by the methods and/or with the device and installations in accordance with the invention.

BRIEF DESCRIPTION OF DRAWINGS

The invention will be readily understood by means of the non-limitative examples which follow and the diagrammatic figures relating to these examples.

In the drawing.

DESCRIPTION OF PREFERRED EMBODIMENTS

Figure 1:
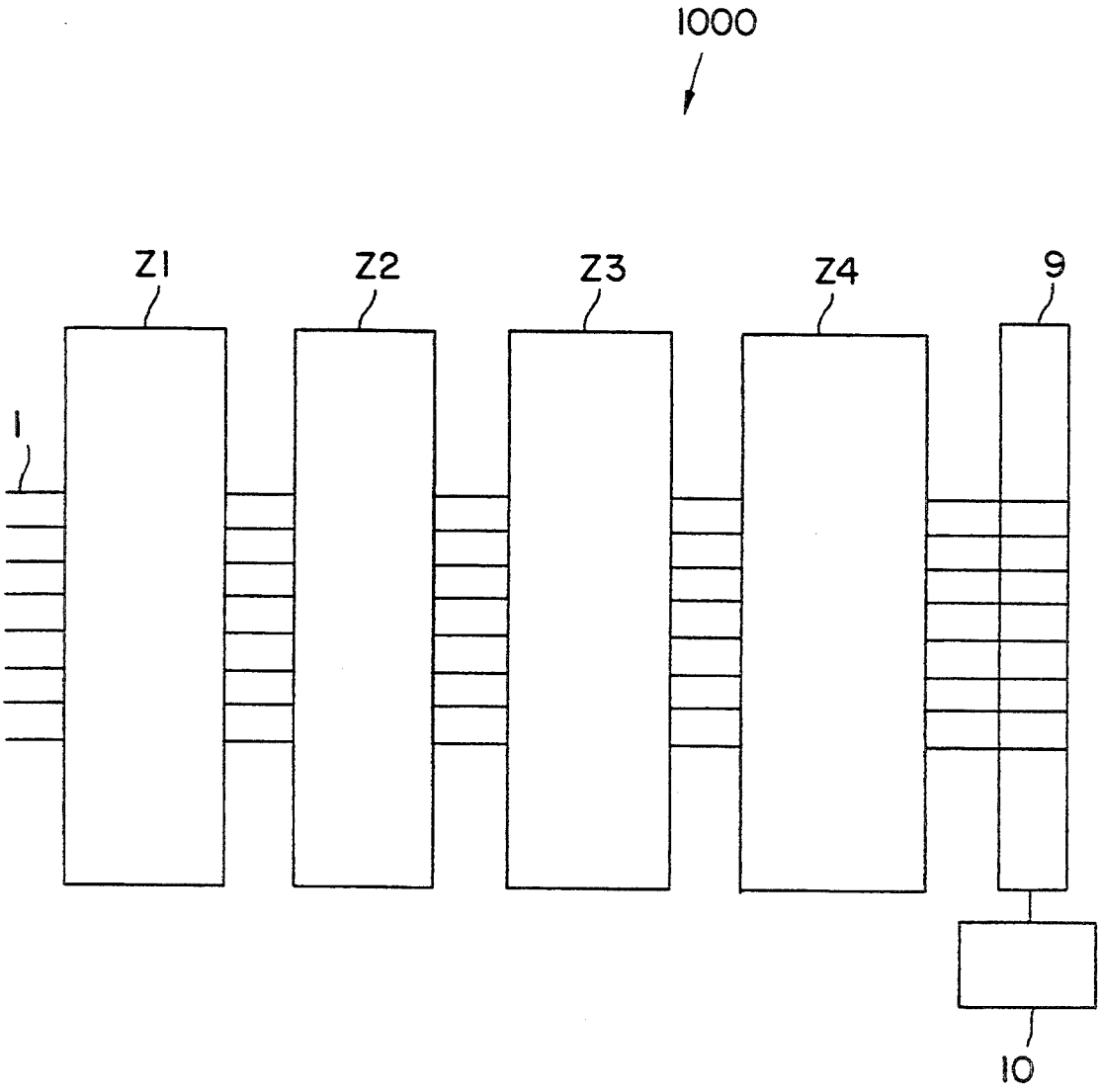
FIG. 1 is a plan view of an installation for thermally treating a plurality of metal wires, this installation using several devices in accordance with the invention.

FIG. 1 shows a complete installation for the treating of carbon-steel wires so as to obtain a fine pearlitic structure. This installation 1000, which permits, for example, the simultaneous treatment of eight wires 1, has four zones marked $Z_1$, $Z_2$, $Z_3$, $Z_4$, the wires 1 passing in succession through these four zones in that order.

Zone $Z_1$ corresponds to an austenitization treatment. In this zone the wires 1 are heated to a temperature above the AC3 transformation temperature in order to obtain a homogeneous austenite.

Zone $Z_2$ corresponds to a rapid cooling which makes it possible to bring the wires 1 to a temperature below the AC1 transformation temperature, so as to obtain a metastable austenite.

Zone $Z_3$ corresponds to the pearlitization treatment, with transformation of metastable austenite into pearlite.

Zone $Z_4$ corresponds to a cooling of the wires in order to bring them to ambient temperature or to a temperature close to ambient temperature.

The austenitization treatment in zone $Z_1$ is carried out in known manner, for instance with a muffle furnace or gas furnace or in accordance with French Patent Application 88/08425, this method consisting in heating the wires by passing them within tubes containing a gas which is practically free of forced ventilation.

Each of the zones $Z_2$, $Z_3$, and $Z_4$ has at least one device in accordance with the invention. Such a device is shown in part in FIG. 2. This device 100 has a pair of thermal transfer plates 2, the wires 1 passing within this pair. The heat conductive plates 2 are made, for instance, of bronze, steel or cast iron.

Figure 2:
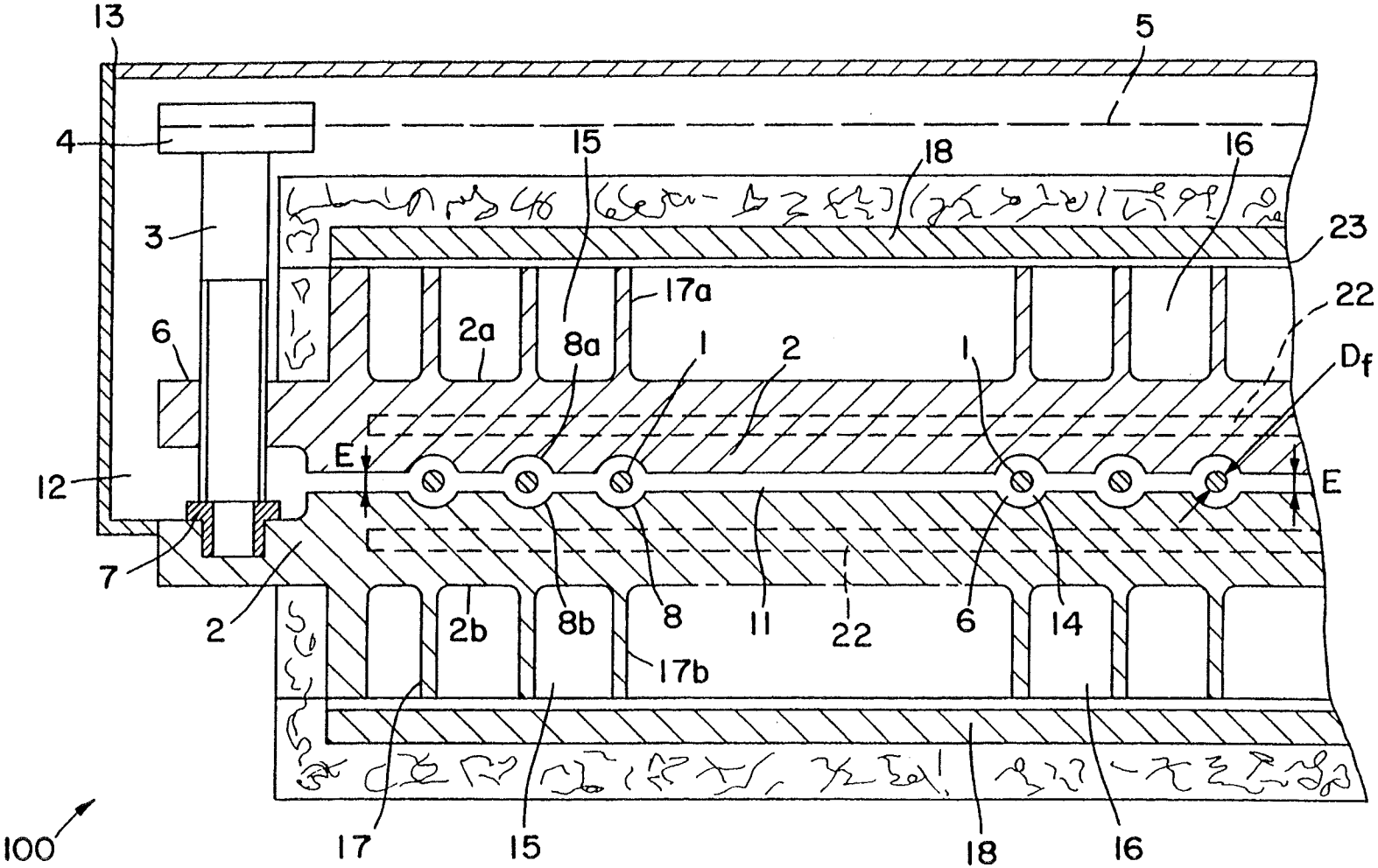
FIG. 2 shows a part of one of the devices used in the installation shown in FIG. 1, FIG. 2 being a section taken in a plane perpendicular to the longitudinal direction of the wires.

FIG. 2 is a section taken along a plane perpendicular to the longitudinal direction of the wires 1, which are all parallel to each other.

The two plates 2 are parallel to each other and arranged one above the other, the upper plate being designated 2*a* and the lower plate being designated 2*b*. The plates 2*a*, 2*b* are separated by the distance E which may be varied by at least three screws 3, for instance four screws; for simplicity in the drawing only a single one of these screws has been shown in FIG. 2. The movement of rotation of each screw 3 can be synchronized by means of the toothed wheel 4 forming an extension of the screw 3, and the chain 5. The screw 3 is in engagement with a thread 6 developed in the upper transfer plate 2*a* and rests against a ball stop or a bronze bearing 7 placed in the lower transfer plate 2*b*. The other screws have identical arrangements, the chain 5 connecting all the wheels 4 together to assure the synchronization of the displacements and therefore the parallelism of the plates, that is to say the same value of the distance E along the plates 2.

Each plate 2*a*, 2*b* has grooves 8, one for each wire. Each groove 8*a* of the plate 2*a* faces a groove 8*b* of the plate 2*b*. The shape of the grooves is, for instance, the same for plates 2*a*, 2*b*. By way of example, each of the grooves 8 has the shape of a half-cylinder of revolution the axis of which is parallel to the longitudinal direction of the wires 1, the grooves 8 therefore having the shape of a half-circle in a section perpendicular to the longitudinal direction of the wires, that is to say in the section of FIG. 2.

In this section, the combination of two grooves 8*a*, 8*b* which face each other constitutes a circle which corresponds to the case that these two grooves touch each other when E=O. The surface of this combination in section is designated S and Di is given by the equation:

$$Di = \sqrt{4S/\pi} \tag{2}$$

Di being, in the particular case described, the diameter of the half circle corresponding to the sections of each of the grooves 8 in FIG. 2.

Each wire 1 passes between two grooves 8*a*, 8*b* which face each other. These grooves are so provided that the wire 1 can pass between these grooves when they are in contact with each other, that is to say, Di>Dr, Df being the diameter of the wire 1.

The means which make it possible to advance each wire 1 between the plates 2 comprise, for instance, the reel 9 arranged beyond the zone $Z_4$. The wires 1 are wound on the reel after the treatment, the reel 9 being driven by the motor 10 (FIG. 1).

The wires 1 are directly in contact with a gas 11 which fills the grooves 8 and is practically without forced ventilation, this gas 11 being in communication with the chamber 12, outside the plates 2, this chamber 12 being defined within the enclosure 13.

Di, λ, Df and S make it possible to define the coefficient K:

$$K = \frac{\text{Log}\,(Di/Df)}{\lambda} \times Df^2 \tag{1}$$

Log being the natural logarithm and λ being the thermal conductivity of the gas 11 determined at 600° C., expressed in watt.m$^{-1}$.°$^{-1}$.

The gas 11 is, for instance, hydrogen, nitrogen, helium, a mixture of hydrogen and nitrogen, of hydrogen and methane, of nitrogen and methane, of helium and methane or of hydrogen, nitrogen and methane.

Variation of the distance E modifies the shape of the sleeve 14 of gas 11 surrounding each wire 1, which makes it possible to control the heat exchanges between the wires 1 and the plates 2 via the gas 11, the maximum heat exchanges corresponding to E=O.

Figure 3:
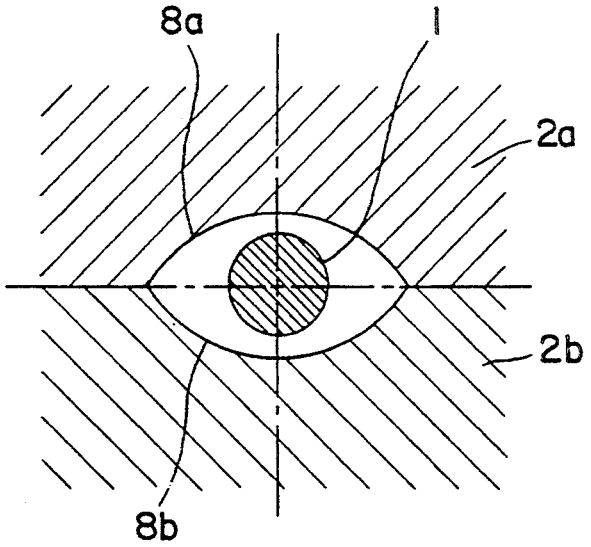
FIGS. 3 and 4 show different shapes of grooves of the device shown in FIG. 2, FIGS. 3 and 4 being sections taken in the same manner as FIG. 2.
Figure 4:
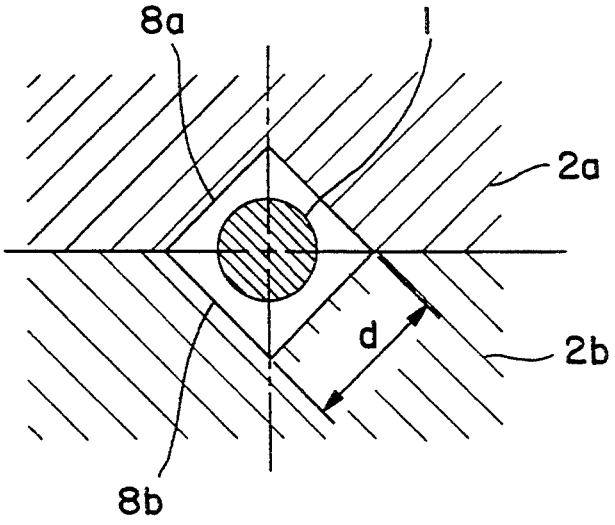

The invention is not limited to the case that the grooves 8 have the shape of a half-circle in cross section. Thus, for instance, FIG. 3 shows two grooves 8*a*, 8*b* facing each other each of which has the form of a circular arc less than half a circle, and FIG. 4 shows two grooves 8*a*, 8*b* facing each other, each of which has the shape of half a square. These figures are sections taken in a manner similar to FIG. 2, that is to say, perpendicular to the axis of the wire 1 which they surround, these grooves being shown in the case that the plates 2*a*, 2*b* are in contact with each other, and therefore with E=O.

Whatever the shape of the grooves, Equation (2) is always true, that is to say, for instance, in the case of FIG. 4, one has $$Di = 2d\sqrt{1/\pi},$$

d being the length of the side of the square.

On the side opposite the wires 1, each plate 2 is in contact with a space 15 in which a heat-exchange fluid 16, for instance water, flows. The plates 2 are extended into the spaces 15 by fins 17 which facilitate the heat exchanges between the plates 2 and the fluid 16.

For each plate 2 there is preferably used a number of fins 17 which is equal to the number of wires 1 treated, and these fins 17 are arranged along the axis of the wires 1 (FIG. 2), a fin 17*a* of the plate 2*a* being located practically in the same plane as a fin 17*b* of the plate 2*b*, the axis of a wire 1 being arranged in this plane. The space 15 is closed by the cover 18, tightness being assured by the joint 23.

Figure 5:
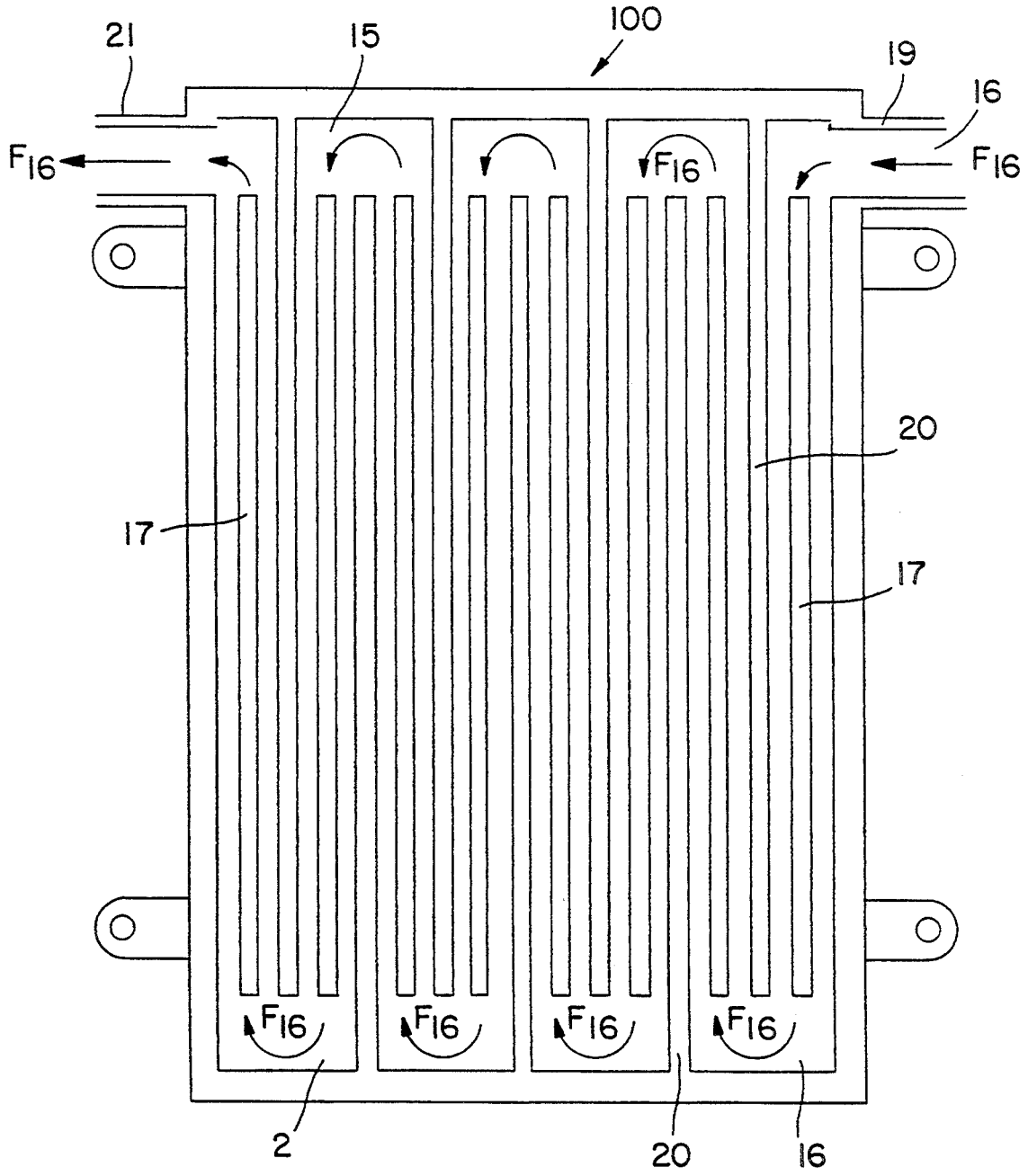
FIG. 5 is a view showing the passages on a side of a plate for the flow of a heat-exchange fluid used in the device shown in FIG. 2.

FIG. 5 shows a space 15, the cover 18 being removed. The fluid 16 arrives through the conduit 19 and then flows along the fins 17. Deflector walls 20 cause changes in direction upon this flow, indicated diagrammatically by the arrows F16 in FIG. 5. The fluid 16 then emerges from the device 100 through the conduit 21. The device 100 has electric resistors 22 arranged in the plates 2, making it possible to heat the plates 2 if so desired. In this case, the fluid 16 is preferably not circulated, since the fluid serves to evacuate the heat coming from the wires 1 towards the outside.

A flow of fluid 16 can be traced in FIG. 5 for a single one of the plates 2.

Figure 6:
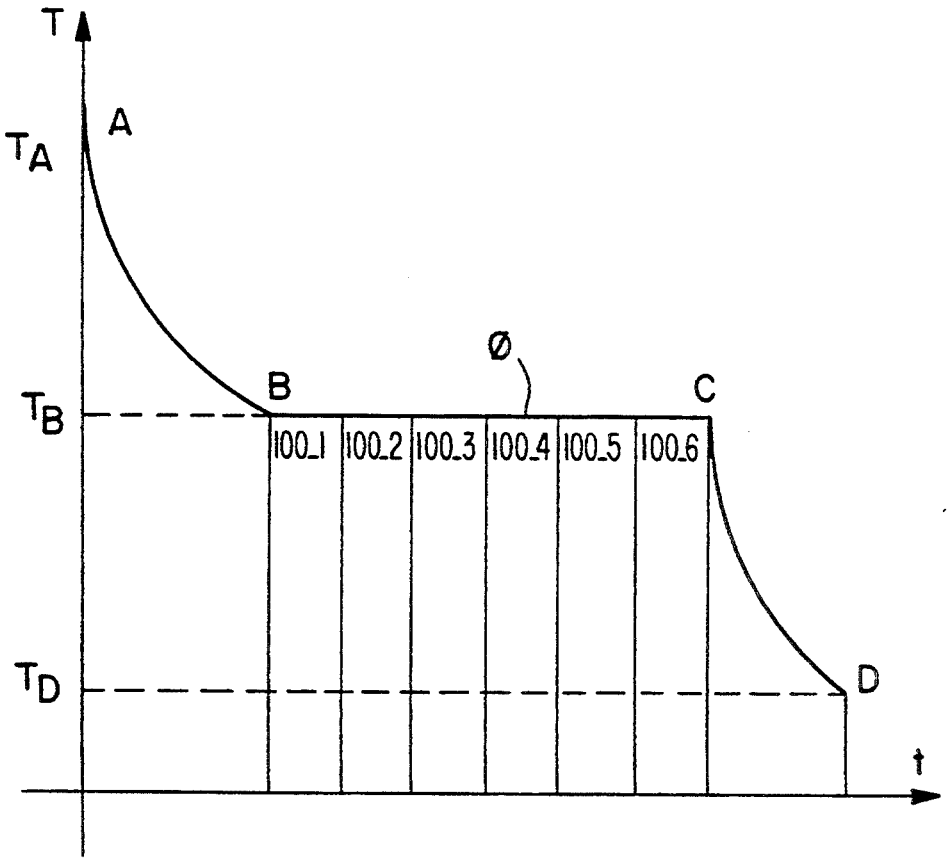
FIG. 6 is a chart which shows the change in temperature as a function of time for a wire treated in the installation shown in FIG. 1.

FIG. 6 shows the treatment diagram $\phi$ of a wire 1 upon its passage through the zones $Z_2$ to $Z_4$ of the installation 1000, the abscissa axis representing the time t and the ordinate axis representing the temperature T of the wire 1.

The time origin corresponds to the point A, which corresponds to the outlet of the zone $Z_1$, the wire 1 at the temperature $T_A$ having a homogenous austenite structure. The portion AB of the diagram corresponds to the rapid cooling in the zone $Z_2$ in order to obtain a metastable austenite, the wire having the temperature $T_B$ at the end of this cooling.

The portion BC of the diagram corresponds to the zone $Z_3$ where the pearlitization of the wire 1 is effected. The temperature of the wire 1 preferably remains as close as possible to $T_B$ in this zone $Z_3$, the variation in temperature being at most equal to 10° C. plus or minus this temperature $T_B$, and preferably at most equal to 5° C. plus or minus $T_B$, in order to avoid or eliminate recalescence phenomena. For purposes of simplification, the portion BC is shown in the form of a straight segment corresponding to the temperature $T_B$.

The portion CD of the diagram corresponds to the cooling of the wire in order to bring it to ambient temperature or to a temperature close to ambient temperature after pearlitization, this final temperature being marked $T_D$.

The device or devices 100 used for the zone $Z_2$ satisfy the relationship:

$$5<K<8 \quad (3)$$

and the same is true, preferably, of the device or devices 100 used for the zone $Z_4$.

The devices 100 used for the zone $Z_3$ satisfy the relationship:

$$3<K<6 \quad (4)$$

In order to have an isothermal or practically isothermal transformation in the zone $Z_3$, several devices 100 are used, for instance six, so as to have modulated heat exchanges. The transformation of the wire 1 in the segment BC is in fact complex and takes place in accordance with the following scheme, from point B to point C:

In the vicinity of B, the formation of seeds at the grain joints of the metastable austenite takes place. The transformation of austenite into pearlite then starts to take place initially at a slow rate, this rate of transformation passing through a maximum and then decreasing and becoming zero. In the vicinity of C, the transformation into pearlite is complete, but the temperature is, nevertheless, maintained practically constant up to C in order to avoid a residue of metastable austenite.

The transformation of austenite into pearlite is very exothermal and the region where the rate of pearlitization is maximum corresponds to a region where the evacuation of the heat must be maximum. In the other regions, the evacuation of the heat need be less, or it may even be necessary to add heat. In order to effect this modulation, one can regulate, for instance, three factors:

apply the plates against each other (E=O) in the zone where the rate of pearlitization is maximum;

move the plates apart (E≠O) and possibly add heat in the other regions.

For a number N of devices 100 used in the zone $Z_3$ there are N-2 ideal configurations possible in which the maximum rate of transformation of austenite into pearlite is in the middle of one of these devices.

For example, for six devices 100 used in the zone $Z_3$ there are four ideal positions indicated diagrammatically in Table 1 below, these devices 100-1 to 100-6 being indicated in this order in FIG. 6 at corresponding time intervals of the segment BC.

TABLE 1

| Ideal | Number of Device | | | | | |
|---|---|---|---|---|---|---|
| Configuration | 100-1 | 100-2 | 100-3 | 100-4 | 100-5 | 100-6 |
| 1 | E ≠ 0 | E = 0 | E ≠ 0 | heat | heat | heat |
| 2 | heat | E ≠ 0 | E = 0 | E ≠ 0 | heat | heat |
| 3 | heat | heat | E ≠ 0 | E = 0 | E ≠ 0 | heat |
| 4 | heat | heat | heat | E ≠ 0 | E = 0 | E ≠ 0 |

The adjustment of the devices 100 of the zone $Z_3$ is obtained, for instance, by means of a computer in the following manner:

The temperatures of the wires 1 is determined at the outlet of the plates 2 by a pyrometer which supplies this information to the computer. The latter then sends signals to valves which control the flow of fluid 16, to valves which permit expelling this fluid (in the case of heating), for instance with compressed air, to motors acting on the wheels 4, and to temperature regulators acting on the electric resistors 22.

The invention is illustrated by the following examples, all of which are in accord with the invention. In these examples, the rate of passage of the wire is 1 meter per second and the eight wires are treated simultaneously. The austenitization produced in the zone $Z_1$ is effected in conventional manner, for instance with a gas or muffle oven, so as to obtain an austenitization temperature $T_A$ of 980° C.

The diameter of the wire is 1.3 mm, the gas 11 is cracked ammonia containing 75% by volume $H_2$ and 25% by volume $N_2$, the conductivity λ at 600° C. being 0.28 watts.m$^{-1}$.°K$^{-1}$.

EXAMPLE 1

The zones $Z_2$ to $Z_4$ of the installation 1000 comprise a total of eight devices 100. The grooves 8 have the shape of half-circles in section, as previously described.

The zone $Z_2$ has a device 100 of a length of 2.7 m. Diameter of the grooves 8: 3.7 mm.

The zone $Z_4$ has a device 100 of a length of 2.5 m. Diameter of the grooves 8: 3.7 mm.

The zone $Z_3$ has six devices 100. Each of these elements has a length of 1 m and is equipped with electric resistors of a total power of 1.5 kW. There are therefore four ideal configurations, as previously indicated.

For the zone $Z_3$ the total length is therefore 6 meters and the time of passage of the wires is six seconds. The diameter of the grooves 8 is 3.2 mm.

Steel wires 1 are used having 0.815% C, 0.527% Mn, 0.219% Si, 0.006% S, 0.012% P, 0.082% Al, 0.045% Ca, 0.020% Cr, 0.008% Ni.

The time corresponding to the passage in the zone $Z_2$ (rapid cooling) is 2.7 seconds. The temperature of the wires 1 in the zone $Z_3$ is 580°±10° C. A configuration of type 1 (Table 1) is noted. The value of the coefficient K is: in the zone $Z_2$: 6.31; in The zone $Z_3$: 5.44; in the zone $Z_4$: 6.31.

After treatment in the installation 1000, the wires 1 have a tensile strength of 1350 MPa. These wires are brass coated and drawn in known manner in order to obtain a final diameter of 0.2 mm, the tensile strength of the drawn wires being 3480 MPa.

The ratio of the cross sections is by definition:

$$R = \frac{\text{cross section of wire before drawing}}{\text{cross section of wire after drawing}}$$

The rational deformation is by definition:

$\epsilon = \text{Log } R$, Log being the natural logarithm.

For the wires 1, one therefore has $R = 42.25$; $\epsilon = 3.74$.

EXAMPLE 2

The zones $Z_2$ to $Z_4$ of the installation 1000 comprise a total of ten devices 100. The grooves 8 have the shape in cross section of half circles, as previously described.

The zone $Z_2$ has a device 100 of a length of 2.7 m. Diameter of the grooves: 3.7 mm.

The zone $Z_4$ has a device 100 of a length of 2.5 m. Diameter of the grooves 8: 3.7 mm.

The zone $Z_3$ has eight devices 100, which therefore corresponds to six possible ideal configurations. Each device 100 has a length of 0.75 m. The length and the time of stay of the wires 1 in this zone $Z_3$ are therefore identical to Example 1. Diameter of the grooves: 3.2 mm.

The other characteristics of the devices 100 are identical to those of Example 1, in particular the nature of the gas 11.

The wires 1 are made with the same steel as in Example 1.

The temperature of the wires 1 in the zone $Z_3$ is 550°±5° C., that is to say, the isothermicity is better than in Example 1. This better isothermicity has made it possible to lower the temperature in the zone $Z_3$ without the danger of the formation of bainite, which makes it possible to improve the mechanical properties and the value in use of the wires 1. The power peak of the transformation of austenite into pearlite is present in the second element 100 of this zone $Z_3$. The coefficient K has the same values as in Example 1 in the zones $Z_2$ to $Z_4$.

After treatment in the installation 1000, the wires 1 have a tensile strength of 1350 MPa. These wires are then brass plated and then drawn in known manner to obtain a final diameter of 0.2 mm. The tensile strength of this drawn wire is 3500 MPa. We have: $R = 42.25$; $\epsilon = 3.74$.

In the embodiments previously described, the distance E was constant in each device 100, but the invention applies to the case that the distance E in one and the same device varies within said device.

Figure 7:
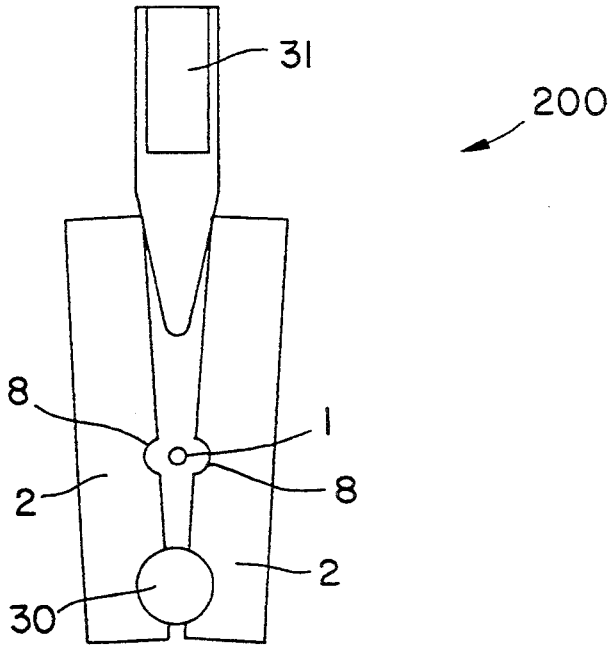
FIG. 7 shows another device according to the invention, in section along a plane perpendicular to the longitudinal direction of the wire treated in this device.

Thus, for instance, FIG. 7 shows a device 200 in accordance with the invention which has two plates 2 connected at one of their ends by a rod 30 parallel to the wire 1 which is arranged between the grooves 8. The plates 2 turn around the rod 30 and therefore the distance E varies in the direction perpendicular to the wire 1. The opening of the plates 2 is obtained, for instance, by means of a wedge-shaped part 31 which moves the plates apart when it is pushed between these plates.

Figure 8:
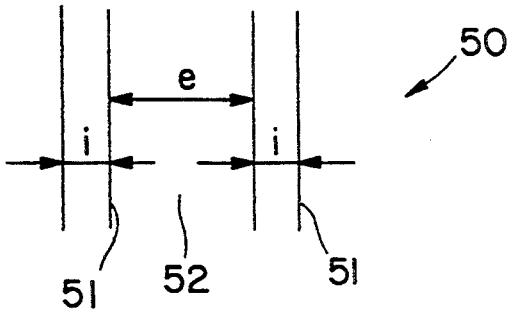
FIG. 8 shows in section a portion of the fine pearlitic structure of a wire treated in the installation shown in FIG. 1.

The wire 1 treated in accordance with the invention has the same structure as the one obtained by the known lead patenting method, that is to say, a fine pearlitic structure. This structure comprises lamellae of cementite separated by lamellae of ferrite. By way of example, FIG. 8 shows in cross section a portion 50 of such a fine pearlitic structure. This portion 50 has two lamella of cementite 51 practically parallel to each other separated by a lamellae of ferrite 52. The thickness of the cementite lamellae 51 is represented by i and the thickness of the ferrite lamellae 52 is represented by e. The pearlitic structure is fine, that is to say, the average value i+e is at most equal to 1000 Å, with a standard deviation of 250 Å.

The invention is described in preferred embodiments and by way of example and is not limited to the embodiments described above.

We claim:

1. A method of thermally treating at least one metal wire, comprising:

(a) passing the wire within at least one pair of heat-transfer plates, between two grooves provided on the two plates of each of these pairs, the distance between the plates being variable, the wire between the grooves being directly in contact with a gas which is practically without forced ventilation, the characteristics of the grooves, the wire and the gas defining the ratio K by the equation:

$$K = \frac{\text{Log}\,(Di/Df)}{\lambda} \times D_f^2 \quad (1)$$

in which $$Di = \sqrt{4S/\pi} \quad (2)$$

Log being the natural log, S being the area of the combination of the two grooves facing each other, this area, expressed in $mm^2$ corresponding to the section of the grooves through a plane perpendicular to the longitudinal direction of the wire, $D_f$ being the diameter of the wire expressed in millimeters and $\lambda$ being the thermal conductivity of the gas determined at 600° C., expressed in watt $.m^{-1}.°K^{-1}$; and (b) adjusting the distance between the plates to select a value of the ratio K according to the heat treatment to be carried out on the wire.

2. A method according to claim 1, in which the distance between the plates is adjusted as a function of the temperature of the wire at the outlet from these plates.

3. A method according to claim 1 for making a fine pearlitic structure comprising the steps of heating the wire at a temperature above the AC3 transformation temperature in order to obtain a homogenous austenite, cooling the wire from the temperature above the AC3 transformation temperature to a temperature below the AC1 transformation temperature, pearlitizing the wire at a temperature lower than the AC1 transformation temperature, and cooling the wire after pearlitization to substantially ambient temperature, the cooling before pearlitization and the pearlitization steps being carried out by passing the wire through at least one said pair of plates adjusted in spaced apart relation to insure that $5<K<8$ during cooling before pearlitization and $3<K<6$ during the pearlitization treatment.

4. A method according to claim 3, in which the cooling operation after pearlitization is effected by passing the wire within at least one pair of said plates adjusted in spaced apart relation to insure that $5<K<8$.

5. A method according to claims 3 or 4, in which the temperature of the wire during the pearlitization treatment does not vary by more than 10° C. plus or minus from a given temperature.

6. A method according to claims 3 or 4, in which at least four pairs of plates are used upon the pearlitization.

* * * * *

UNITED STATES PATENT AND TRADEMARK OFFICE

CERTIFICATE OF CORRECTION

PATENT NO. : 5,423,924
DATED : June 13, 1995
INVENTOR(S) : Reiniche et al.

It is certified that error appears in the above-indentified patent and that said Letters Patent is hereby corrected as shown below:

Col. 4, line 59, " °-1" should read --$°K^{-1}$--.

Signed and Sealed this

Seventeenth Day of October, 1995

*Attest:*

Bruce Lehman

BRUCE LEHMAN

*Attesting Officer*

*Commissioner of Patents and Trademarks*